US008662774B1

(12) United States Patent
Wilson

(10) Patent No.: US 8,662,774 B1
(45) Date of Patent: Mar. 4, 2014

(54) LOTION APPLICATOR ASSEMBLY

(76) Inventor: Lois D. Wilson, Garland, TX (US)

( * ) Notice: Subject to any disclaimer, the term of this patent is extended or adjusted under 35 U.S.C. 154(b) by 126 days.

(21) Appl. No.: 13/239,036

(22) Filed: Sep. 21, 2011

(51) Int. Cl.
*A46B 5/02* (2006.01)

(52) U.S. Cl.
USPC ..... 401/6; 15/209.1; 15/244.1

(58) Field of Classification Search
USPC ..... 401/6, 261, 290; 15/210.1, 209.1, 15/244.1, 144.1, 144.3, 144.4, 145, 118, 15/176.1, 176.6; 16/426, 427, 429
See application file for complete search history.

(56) References Cited

U.S. PATENT DOCUMENTS 4,118,824 A 10/1978 Clement, Jr.
4,961,661 A * 10/1990 Sutton et al. ..... 401/6
5,240,339 A 8/1993 DeForest et al.
5,671,497 A * 9/1997 Abdo ..... 15/144.1
5,823,206 A * 10/1998 Mapleback ..... 132/320
D404,125 S * 1/1999 Weinstein ..... D24/119
6,042,286 A 3/2000 Pazienza
D425,661 S 5/2000 Fenenga
6,210,057 B1 4/2001 Yannaci et al.
6,854,919 B2 * 2/2005 Neumann et al. ..... 403/326
2003/0150078 A1 8/2003 Lottie et al.

* cited by examiner

*Primary Examiner* — David Walczak

(57) ABSTRACT

A lotion applicator assembly includes a plate that has a front side, a back side and a perimeter edge. An absorbent member for absorbing fluids is attached to and covers the front side. The absorbent member has an outer surface positioned opposite of the front side. A handle has a first end, a second end and a perimeter surface extending between the first and second ends. The handle has a longitudinal axis extending through the first and second ends and the handle has a length from the first end to the second end between 8 inches and 24 inches. A coupler is attached to the plate and releasably engages the handle adjacent to the first end to secure the handle to the plate. The plate lies in a plane orientated parallel to the longitudinal axis of the handle. The absorbent member receives lotion to be applied to a person's body.

1 Claim, 5 Drawing Sheets

LOTION APPLICATOR ASSEMBLY

BACKGROUND OF THE DISCLOSURE

Field of the Disclosure

The disclosure relates to lotion application devices and more particularly pertains to a new lotion application device for allowing a person to more easily apply lotion on hard to reach areas of their body.

SUMMARY OF THE DISCLOSURE

An embodiment of the disclosure meets the needs presented above by generally comprising a plate that has a front side, a back side and a perimeter edge. An absorbent member for absorbing fluids is attached to and covers the front side. The absorbent member has an outer surface positioned opposite of the front side. A handle has a first end, a second end and a perimeter surface extending between the first and second ends. The handle has a longitudinal axis extending through the first and second ends and the handle has a length from the first end to the second end between 8 inches and 24 inches. A coupler is attached to the plate and releasably engages the handle adjacent to the first end to secure the handle to the plate. The plate lies in a plane orientated parallel to the longitudinal axis of the handle. The absorbent member receives lotion to be applied to a person's body.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
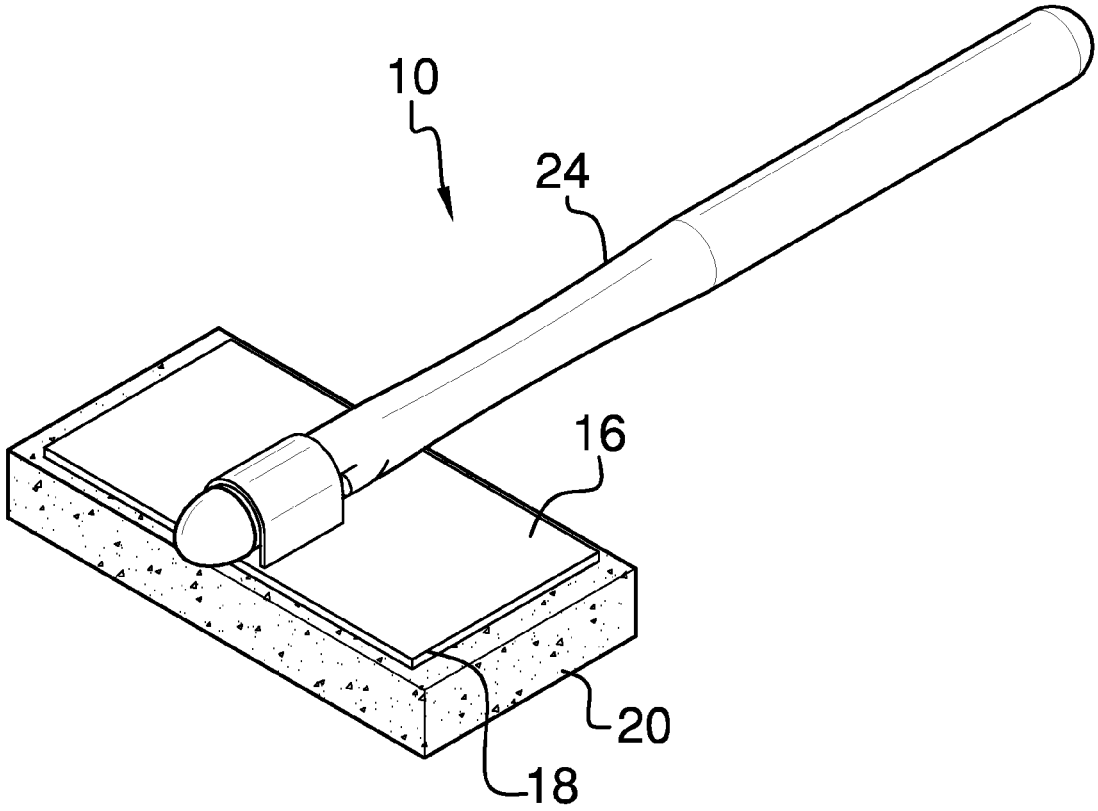
FIG. 1 is a rear perspective view of a lotion applicator assembly according to an embodiment of the disclosure.
Figure 2:
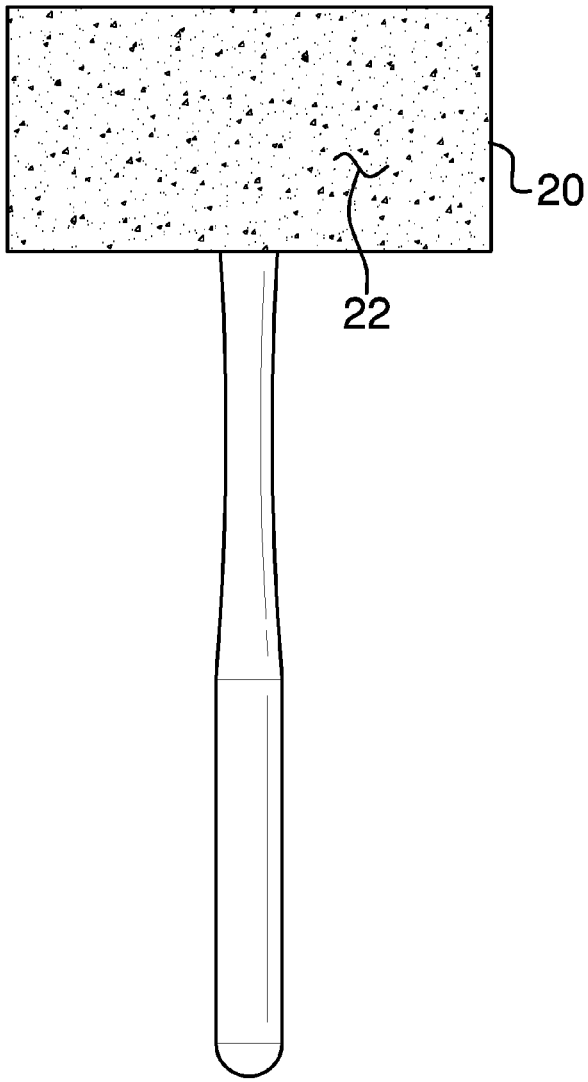
FIG. 2 is a front view of an embodiment of the disclosure.
Figure 3:
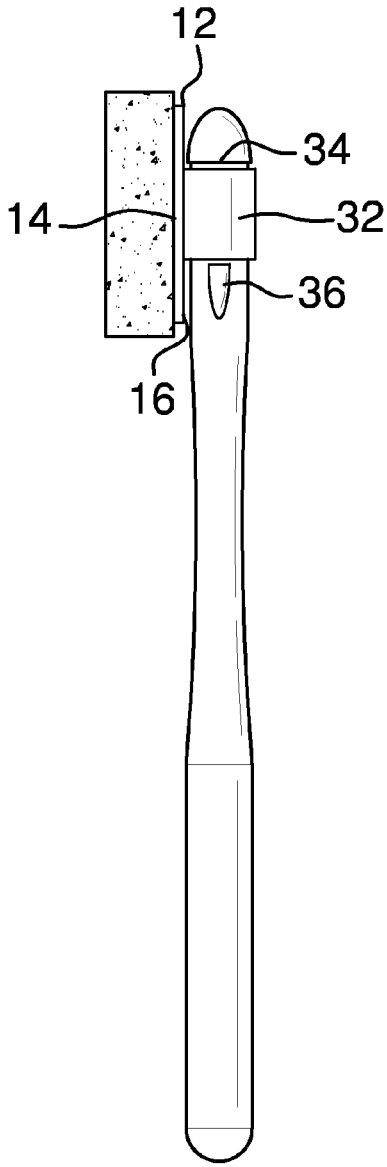
FIG. 3 is a side view of an embodiment of the disclosure.
Figure 4:
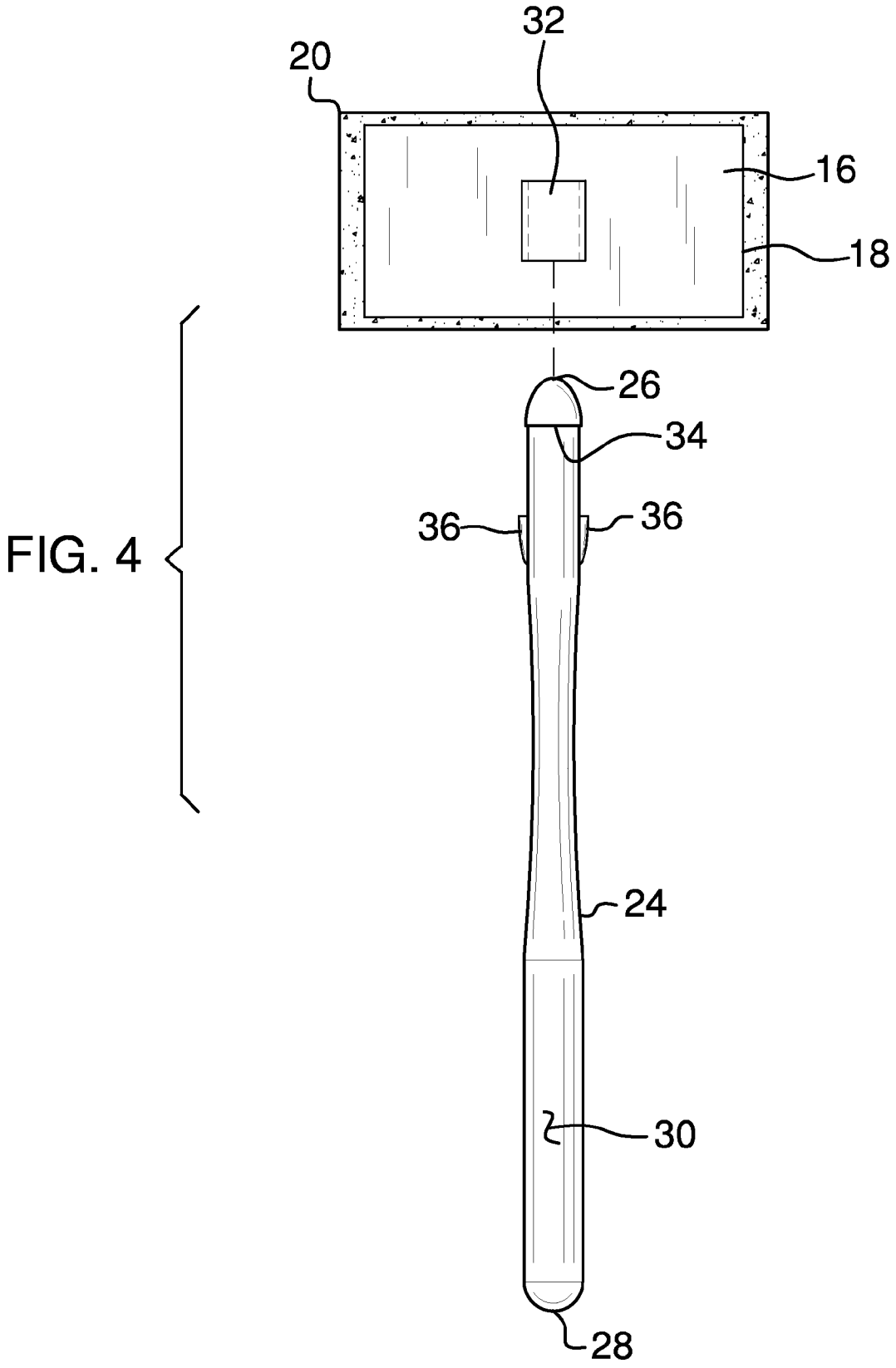
FIG. 4 is a rear view of an embodiment of the disclosure.
Figure 5:
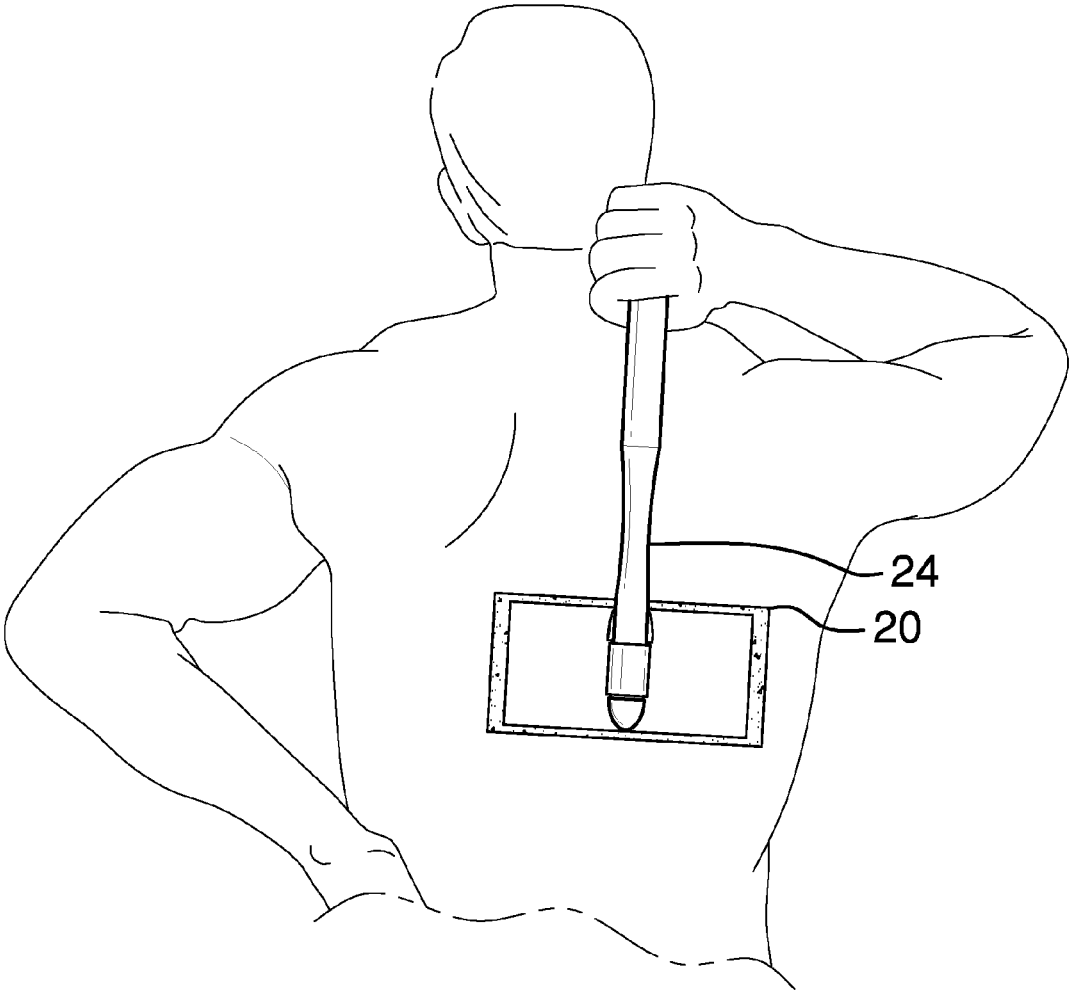
FIG. 5 is a rear in-use view of an embodiment of the disclosure.

With reference now to the drawings, and in particular to FIGS. 1 through 6 thereof, a new lotion application device embodying the principles and concepts of an embodiment of the disclosure and generally designated by the reference numeral 10 will be described.

As best illustrated in FIGS. 1 through 6, the lotion applicator assembly 10 generally comprises a plate 12 that has a front side 14, a back side 16 and a perimeter edge 18. The plate 12 has a length and a width each between 3 inches and 8 inches and a depth from the front side 14 to the back side 16 is less than 0.25 inches. The plate 12 may have a generally rectangular configure and be comprised of a plastic material.

An absorbent member 20 for absorbing fluids is attached to and covers the front side 14. As is shown in the Figures, the absorbent member 20 may extend beyond the perimeter edge 18 of the plate 12. The absorbent member 20 has an outer surface 22 positioned opposite of the front side 14 and a distance from the outer surface 22 to the back side 16 is less than 1.5 inches. The absorbent member 20 may be comprised of a sponge material such as a foamed elastomer.

A handle 24 has a first end 26, a second end 28 and a perimeter surface 30 extending between the first 26 and second 28 ends. The perimeter surface 30 may generally form a cylindrical shape which may include areas of different diameter. The handle 24 has a longitudinal axis extending through the first 26 and second 28 ends. The handle 24 has a length from the first end 26 to the second end 28 between 8 inches and 24 inches and the handle 24 may have a fixed length.

A coupler 32 is attached to the plate 12 and more particular to a back side 16 of the plate 12. The coupler 32 releasably engages the handle 24 adjacent to the first end 26 to secure the handle 24 to the plate 12. The plate 12 lies in a plane orientated parallel to the longitudinal axis of the handle 24 and a distance between the back side 16 of the plate 12 and the perimeter surface 30 of the handle 24 is less than 0.5 inches. The coupler 32 may comprise a loop configured for receiving the first end 26. The coupler 32 is retained between a lip 34 and a stop 36 on the handle 24.

Figure 6:
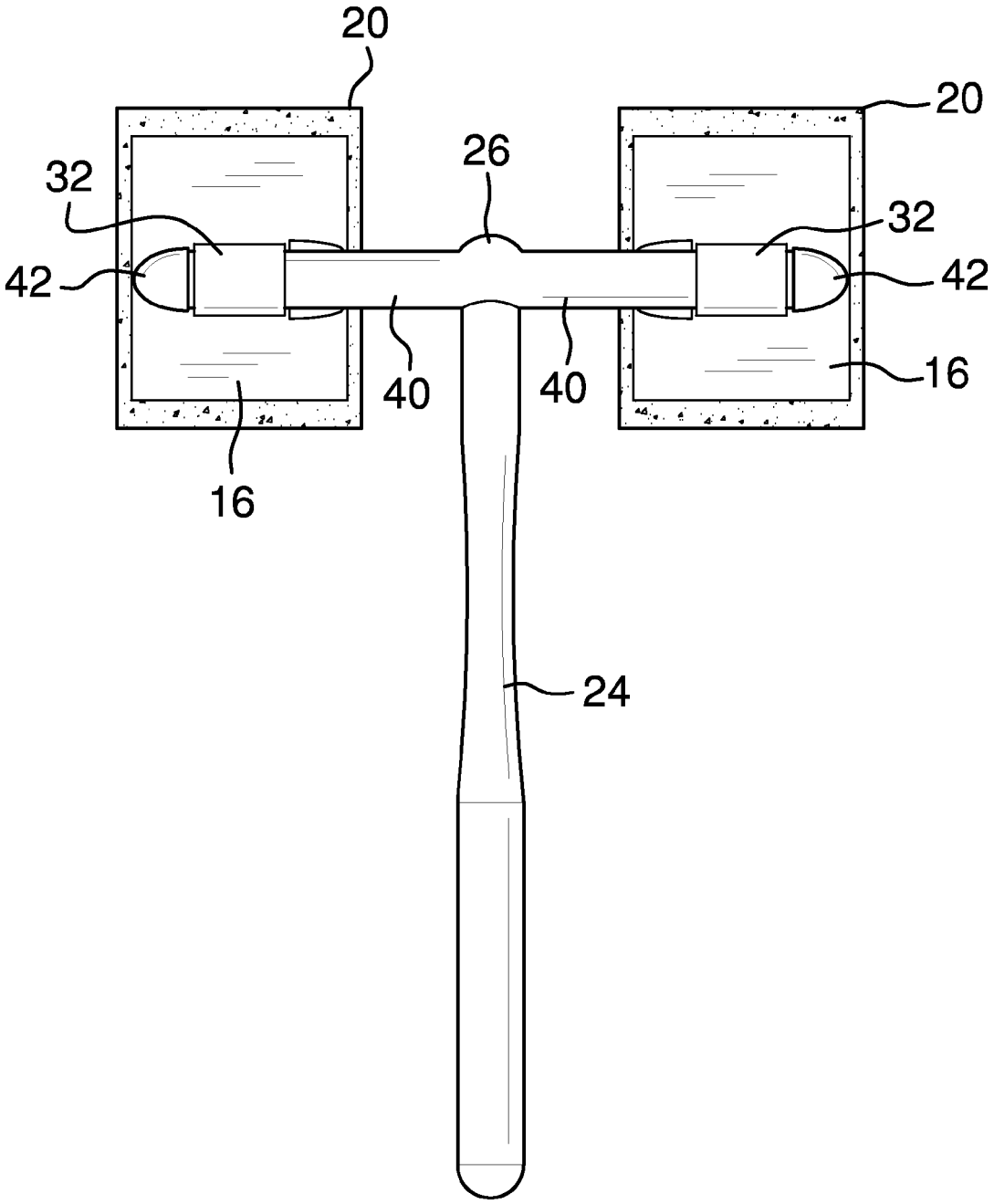
FIG. 6 is a rear view of an embodiment of the disclosure.

An embodiment in FIG. 6 utilizes a pair of plates 12 with attached absorbent members 20 as described above. However, the handle 24 includes a pair of arms 40 attached to the first end 26. Each of the arms 40 has distal end 42 with respect to the handle 24 and the arms 40 are configured to engage the couplers 32.

In use, lotion is applied to the absorbent member 20 so that the absorbent member 20 becomes at least partially saturated with the lotion. The absorbent member 20 is then rubbed on the skin of person, and in particular parts of the person's body which are difficult to reach, such as the back. The positioning of the handle 24 relative to the plate 12 allows for easy abutment of the outer surface 22 against the skin.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A lotion application assembly comprising:

a pair of plates each having a front side, a back side and a perimeter edge, each said plate having a length and a width each between 3 inches and 8 inches, each said plate having a depth from said front side to said back side of said associated plate being less than 0.25 inches;

a pair of absorbent members for absorbing fluids, each absorbent member being attached to and covering said front side of an associated one of said plates, each said absorbent member having an outer surface positioned opposite of said front side of said associated plate, a distance from said outer surface of an associated one of said plates to said back side of said associated plate being less than 1.5 inches;

a handle having a first end, a second end and a perimeter surface extending between said first and second ends, said handle having a longitudinal axis extending through said first and second ends, said handle having a length from said first end to said second end between 8 inches and 24 inches, said handle having a fixed length, a distance between said back side of each of said plates and said perimeter surface of said handle being less than 0.5 inches;

a pair of arms coupled to and extending from said handle, each of said arms being positioned transverse relative to said longitudinal axis of said handle, each of said arms being attached to said first end of said handle, said arms extending in opposite directions relative to each other, each of said arms having a lip offset from said first end of said handle;

a pair of couplers, each coupler being attached to an associated one of said plates, each said coupler releasably engaging an associated one of said arms to secure said handle to said associated plate, each said plate lying in a plane orientated parallel to said longitudinal axis of said handle;

a pair of stops, each of said stops being coupled to and extending from an associated one of said arms, each of said stops being positioned in spaced relationship to an associated one of said lips;

each of said couplers being a loop positionable to extend between an associated one of said lips and an associated one of said stops wherein said couplers are retained on said associated arm; and wherein each said absorbent member is configured to receive lotion to be applied to a person's body.

* * * * *